US009669364B2

(12) United States Patent
Chan et al.

(10) Patent No.: US 9,669,364 B2
(45) Date of Patent: Jun. 6, 2017

(54) BUBBLE ATOMIZER AND METHOD FOR ATOMIZING LIQUID

(71) Applicant: Acoustic Arc International Limited, Hong Kong (HK)

(72) Inventors: Ho Yin Chan, Hong Kong (HK); Wen J. Li, Hong Kong (HK); Boa Fung Chau, Hong Kong (HK); Kak Man Chan, Hong Kong (HK)

(73) Assignee: ACOUSTIC ARC INTERNATIONAL LIMITED, Hong Kong (HK)

( * ) Notice: Subject to any disclaimer, the term of this patent is extended or adjusted under 35 U.S.C. 154(b) by 61 days.

(21) Appl. No.: 14/873,232

(22) Filed: Oct. 2, 2015

(65) Prior Publication Data

US 2017/0095779 A1 Apr. 6, 2017

(51) Int. Cl.

| | |
|---|---|
| ***B01F 3/04*** | (2006.01) |
| ***B01F 15/00*** | (2006.01) |
| ***B01F 15/06*** | (2006.01) |
| ***B01F 5/06*** | (2006.01) |

(52) U.S. Cl.

CPC ..... *B01F 3/04063* (2013.01); *B01F 5/0693* (2013.01); *B01F 15/00279* (2013.01); *B01F 15/066* (2013.01); *B01F 2015/062* (2013.01)

(58) Field of Classification Search

CPC ..... B01F 3/04; A24F 47/008; F24H 1/0018

USPC ..... 261/142

See application file for complete search history.

(56) References Cited

U.S. PATENT DOCUMENTS

2015/0114409 A1* 4/2015 Brammer ..... H05B 3/02 131/329

FOREIGN PATENT DOCUMENTS

| | | | |
|---|---|---|---|
| CN | 1284493 | C | 11/2006 |
| CN | 102000647 | B | 9/2012 |
| EP | 2462833 | A | 6/2012 |
| EP | 2548653 | A | 1/2013 |

* cited by examiner

*Primary Examiner* — Robert A Hopkins

(57) ABSTRACT

A bubble atomizer includes a cartridge having an open end, a liquid absorbing member provided inside the cartridge, a firing chamber covering the open end and formed with liquid outlets and liquid inlets through which liquid enters the firing chamber from the cartridge, and heaters mounted inside the firing chamber. The heaters are connected with a power electronics unit through a cable. Each heater has a thickness in micron to sub-micron scale. When a pulse signal generated is applied to the heaters, current generated heats up the heaters and vapor bubbles are formed on the heaters that generate pressure and push the liquid out of the firing chamber through the liquid outlets to thereby form droplets.

18 Claims, 19 Drawing Sheets

BUBBLE ATOMIZER AND METHOD FOR ATOMIZING LIQUID

FIELD OF THE TECHNOLOGY

The present application relates to a bubble atomizer and a method for atomizing a liquid.

BACKGROUND

Atomizing devices are known and include either a gaseous propellant for discharging a liquid spray or a hand operable piston pump. Some atomizing devices include a reciprocating pump for supplying compressed air to the dispenser, and a motor for driving the pump. Upon operation of the motor, compressed air is delivered directly to the dispenser from the pump to atomize liquid and spray atomized liquid from an orifice. These existing atomizing devices are complicated in structure, heavy in weight, and high in manufacturing cost. Therefore, there is a need to provide a simple and portable atomizing device.

The above description of the background is provided to aid in understanding the bubble atomizer, but is not admitted to describe or constitute pertinent prior art to the bubble atomizer.

SUMMARY

According to one aspect, there is provided a bubble atomizer which may include a cartridge having an open end; a liquid absorbing member provided inside the cartridge for holding therein a liquid; a heater chip covering the open end of the cartridge and formed with a plurality of liquid inlets through which the liquid from the cartridge passes; a plurality of heaters mounted on the heater chip and connected to a power electronics unit through a cable, each heater having a thickness in micron to sub-micron scale; a nozzle plate formed with a plurality of micron-sized liquid outlets and spaced apart from the heater chip by a spacer to define thereinbetween a firing chamber; and a plurality of guiding members formed on a surface of the heater chip where the heaters are mounted, the guiding members being configured to divide the firing chamber into a plurality of sub-chambers and guide liquid movement in the sub-chambers. When a pulse signal generated from the power electronics unit is applied to the heaters, current generated heats up the heaters and a plurality of vapor bubbles is formed on the heaters which generates pressure and pushes the liquid out of the firing chamber through the liquid outlets to thereby form a plurality of droplets.

According to another aspect, there is provided a bubble atomizer for atomizing a liquid, the bubble atomizer may include a cartridge having an open end; a liquid absorbing member provided inside the cartridge for holding therein a liquid; a firing chamber covering the open end of the cartridge, the firing chamber being formed with at least one micron-sized liquid outlet and at least one liquid inlet through which the liquid enters the firing chamber from the cartridge; and at least one heater mounted inside the firing chamber and connected with a power electronics unit through a cable, the heater having a thickness in micron to sub-micron scale. When a pulse signal generated from the power electronics unit is applied to the heater, current generated heats up the heater and at least one vapor bubble is formed on the heater which generates pressure and pushes the liquid out of the firing chamber through the liquid outlet to thereby form at least one droplet.

In one embodiment, the firing chamber may include a heater chip on which the heater is mounted and the liquid inlet is formed. The firing chamber further includes a nozzle plate on which the liquid outlet is formed, and the nozzle plate is spaced apart from the heater chip by a spacer.

In one embodiment, the bubble atomizer may further include at least one guiding member formed on a surface of the heater chip where the heater is mounted, the guiding member being configured to divide the firing chamber into a plurality of sub-chambers and guide liquid movement in the sub-chambers.

In one embodiment, the liquid absorbing member may include a proximal part that is in contact with the heater chip, and a distal part that is in contact with the proximal part and disposed at a distance from the heater chip. The density of the distal part may be higher than that of the proximal part, whereby the liquid in the distal part is absorbed, filtered and passed to the proximal part in which the liquid is absorbed and any excessive liquid is held. The liquid absorbing member may be made of foam.

In one embodiment, the firing chamber may be provided with two or more groups of heater which are electrically operable independently.

In one embodiment, the heater may be made of metal and may have a thickness of 300 nm. The micron-sized liquid outlet may have a diameter of 25 um. The liquid may be a substance selected from the group consisting of water, aroma, medicine and perfume.

According to a further aspect, there is provided a method for atomizing a liquid with a bubble atomizer including the steps of providing at least one heater in a firing chamber, the heater having a thickness in micron to sub-micron scale; filling up the firing chamber with a liquid from a liquid reservoir through at least one liquid inlet formed on the firing chamber; and applying a pulse signal to the heater by a power electronics unit to thereby generate current that heats the heater up to 200° C.-300° C. for a period of time measured in terms of millisecond to microsecond, thereby forming at least one vapor bubble on the heater which generates pressure and pushes the liquid out of the firing chamber through at least one liquid outlet formed on the firing chamber to thereby form at least one droplet.

The method may further include the step of drawing liquid from the liquid reservoir to the firing chamber as the vapor bubble collapses to thereby refill the firing chamber. The liquid outlet may have a lower resistance for the liquid to pass through than that of the liquid inlet.

In one embodiment, the liquid reservoir may be provided therein with a liquid-absorbing member for absorbing and holding the liquid such that the atomizer can operate at any angle without affecting its atomization function.

The method may include the steps of providing two or more groups of heater which are electrically operable independently, and sequentially activating the groups of heater. The method may include the steps of providing two or more groups of heater which are electrically operable independently, and simultaneously activating the groups of heater.

The method may further include the steps of providing two or more groups of heater which are electrically operable independently, and adjusting atomization rate by activating different groups of heater.

Although the bubble atomizer is shown and described with respect to certain embodiments, it is obvious that equivalents and modifications will occur to other skilled in the art upon the reading and understanding of the specification. The bubble atomizer in the present application includes all such equivalents and modifications, and is limited only by the scope of the claims.

BRIEF DESCRIPTION OF THE DRAWINGS

Specific embodiments of the bubble atomizer will now be described by way of example with reference to the accompanying drawings wherein:

FIG. 15(*b*) shows a heater chip having a circle-shaped array of heaters.

FIG. 15(*c*) shows a heater chip having two inlets.

FIG. 15(*d*) shows a heater chip having four inlets.

DETAILED DESCRIPTION

Figure 1:
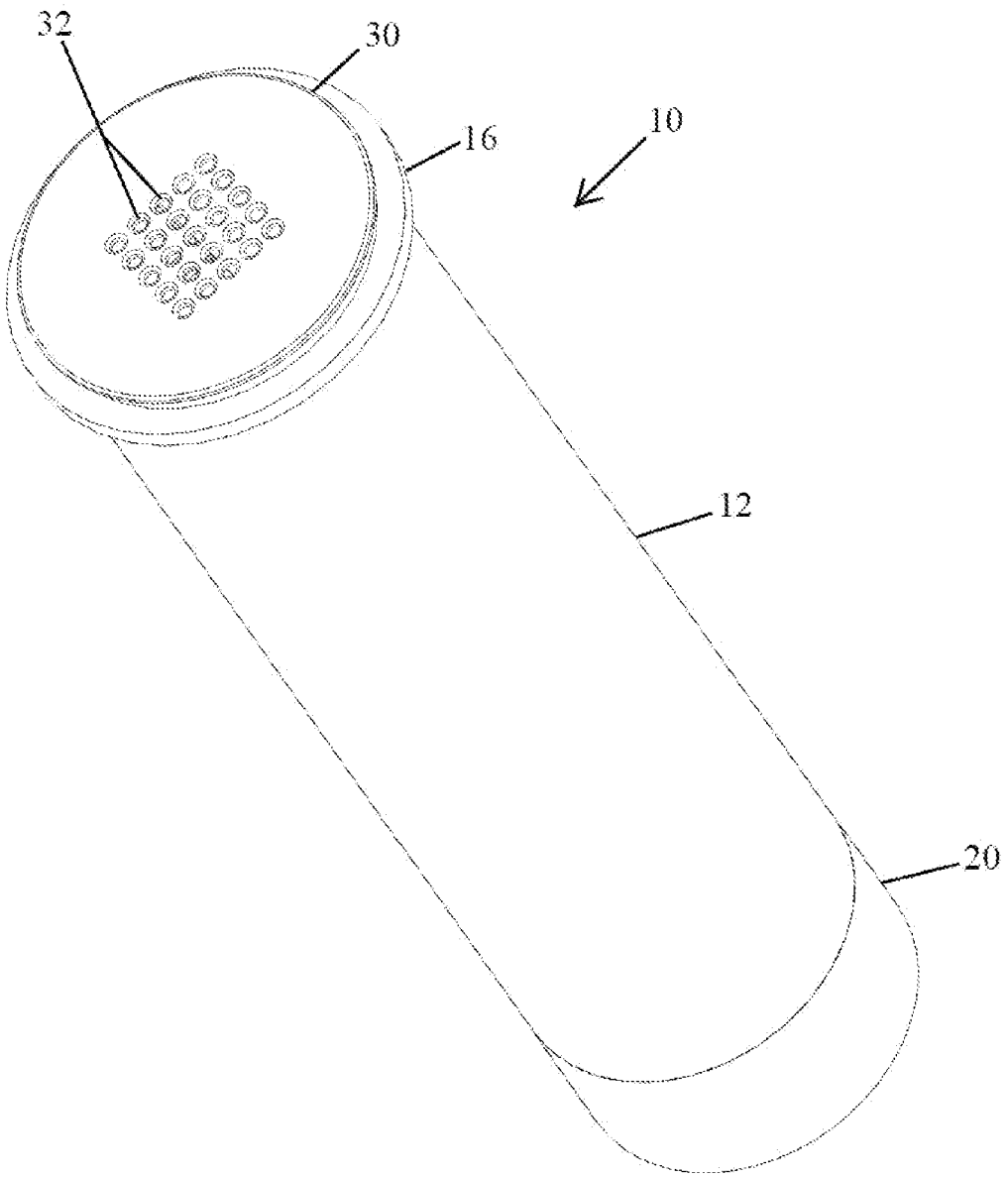
FIG. 1 is a perspective view of a bubble atomizer according to an embodiment disclosed in the present application.

Reference will now be made in detail to a preferred embodiment of the bubble atomizer, examples of which are also provided in the following description. Exemplary embodiments of the bubble atomizer are described in detail, although it will be apparent to those skilled in the relevant art that some features that are not particularly important to an understanding of the bubble atomizer may not be shown for the sake of clarity.

Furthermore, it should be understood that the bubble atomizer is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure and appended claims.

For illustration purposes, the terms such as "upper", "lower", "vertical", "horizontal", "top" and/or "bottom" appeared hereinafter relate to the invention as it is oriented in the drawings. It is understood that the invention may assume various positions, except where expressly specified to the contrary. Furthermore, it is understood that the specific devices shown in the drawings, and described in the following description, are simply exemplary embodiments of the invention. Hence, specific dimensions and other physical characteristics related to the embodiments disclosed hereinafter are not to be considered as limiting.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element or is in mechanical, electrical or optical communication with another element.

Figure 2:
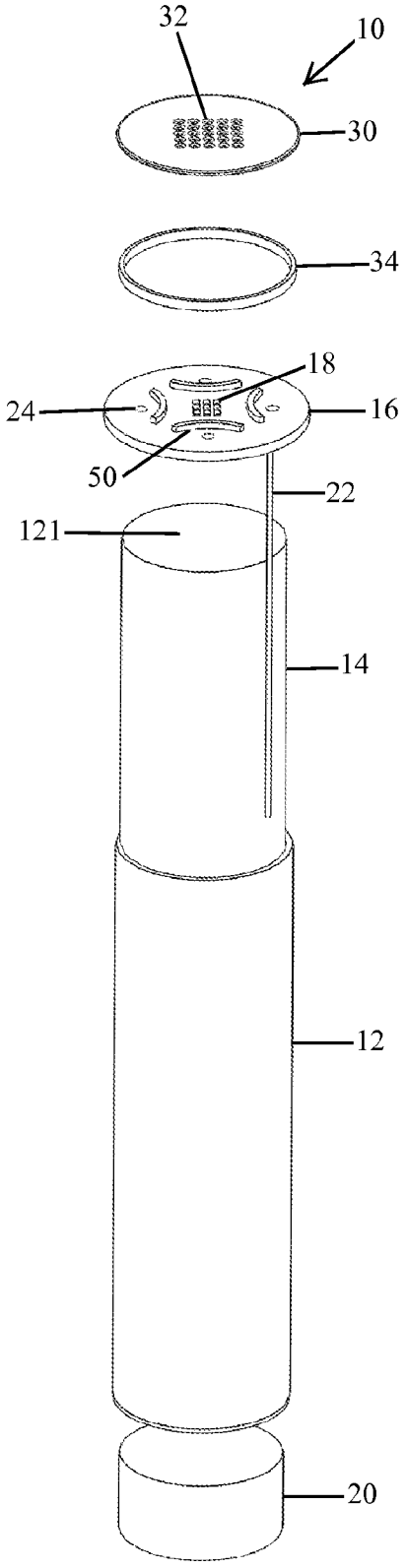
FIG. 2 is an exploded view of the bubble atomizer according to an embodiment disclosed in the present application.

FIGS. 1 and 2 show different views of a bubble atomizer 10 according to an embodiment disclosed in the present application. As used herein, the term "bubble atomizer" means an atomizer which adopts an atomizing principle based on thermal bubble actuation effect. The bubble atomizer 10 may include a cartridge 12 having an open end 121, a liquid absorbing member 14 provided inside the cartridge 12 for holding a liquid, and a heater chip 16 covering the open end 121 of the cartridge 12. The cartridge 12 can define a liquid reservoir for holding the liquid absorbed by the liquid absorbing member 14. Depending on applications, the size and shape of the cartridge 12 can be changed. The liquid absorbing member 14 may be made of any material, such as inkjet foam, that can hold and absorb liquid.

Figure 3:
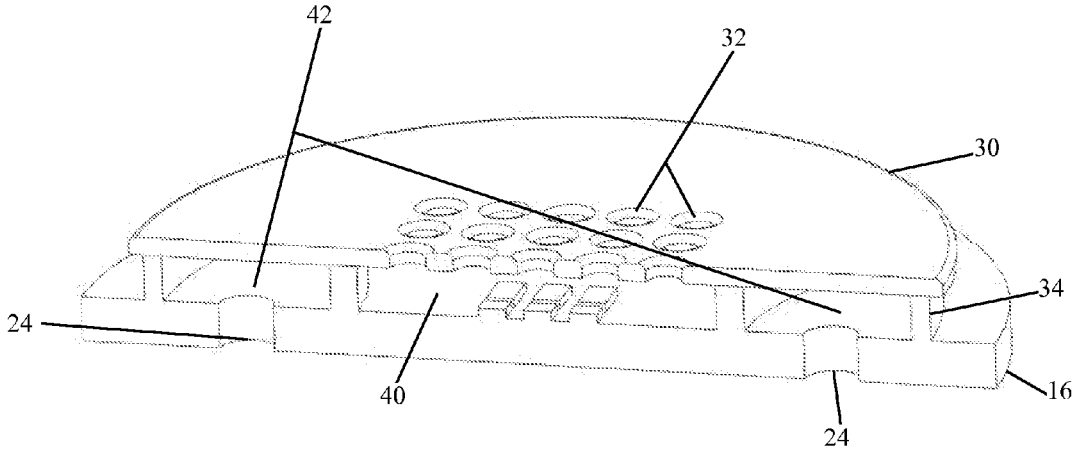
FIG. 3 is a cut-away view of a nozzle plate disposed on a heater chip according to an embodiment disclosed in the present application.
Figure 4:
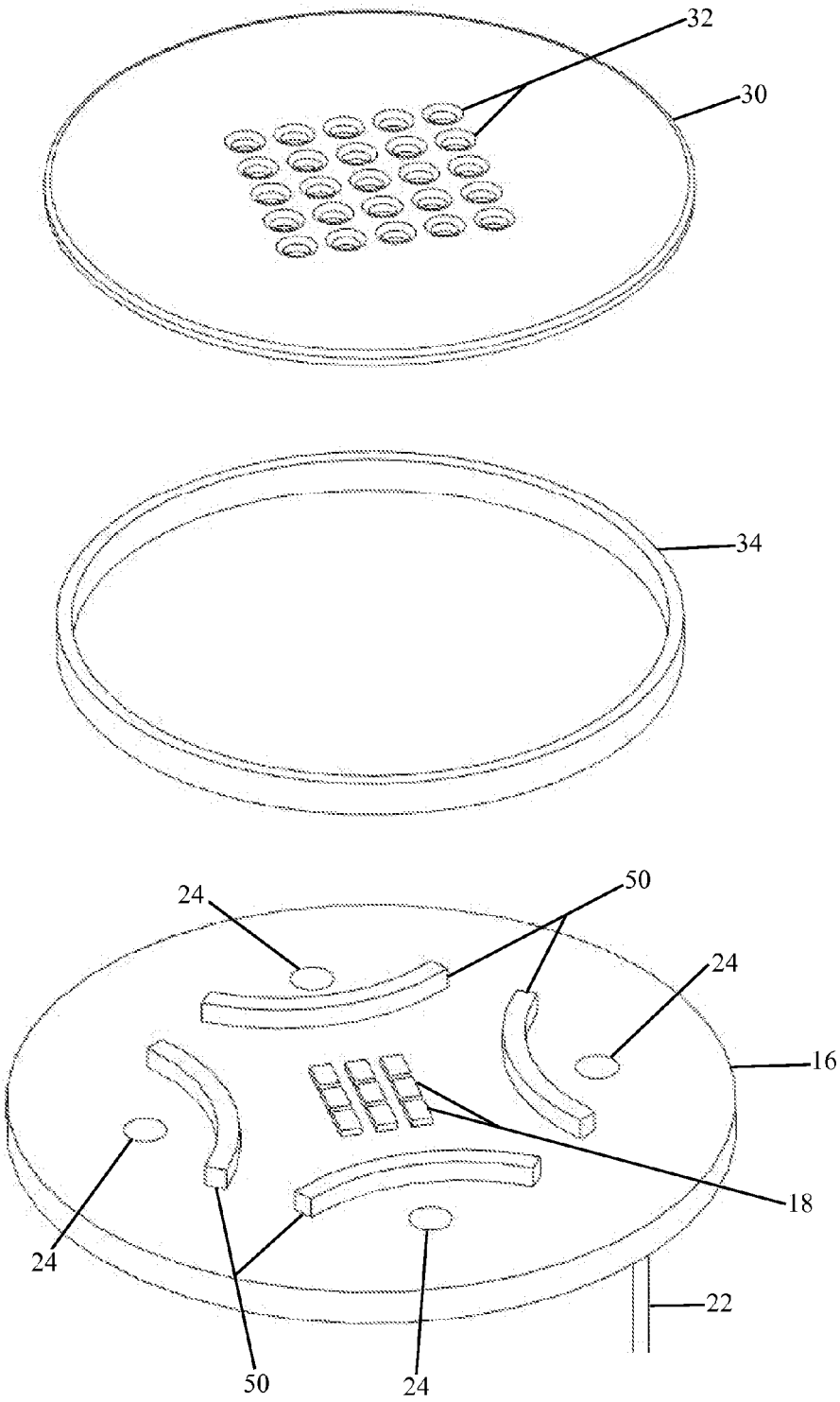
FIG. 4 is an exploded view showing a spacer between the nozzle plate and the heater chip.

The heater chip 16 may be provided with at least one heater 18 which may be connected with a power electronics unit 20 through a cable 22 and formed with at least one liquid inlet 24. The bubble atomizer may include a nozzle plate 30 formed with at least one micron-sized nozzle or liquid outlet 32, and spaced apart from the heater chip 16 by a spacer 34 to thereby define a firing chamber 40 which covers the open end 121 of the cartridge 12. In one embodiment, the micron-sized liquid outlet 32 may have a diameter of 25 um. The liquid inlet 24 can allow liquid flowing from the cartridge 12 to the firing chamber 40. The spacer 34 may be integrally formed with the heater chip 16, as shown in FIG. 3, or separately formed with the heater chip 16, as shown in FIG. 4.

The heater chip 16 can be a silicon based chip which is widely used in micro-electromechanical system (MEMS) and electronic industry. It can also be made of a printed circuit board (PCB). The heater 18 can be any metal or metal alloy (e.g. Au, Ti, TaAl), or doped semiconductor that have higher melting temperature (e.g. doped polySi). The thickness of the heater 18 may be in micron to sub-micron scale. In one embodiment, the heater 18 may have a thickness of 300 nm. It can be superheated by flowing current.

The heater 18 may be in the form of an array of heaters. The array of heaters can be combined together into two or more groups (or sets). Each group of heater may have its own electrical connection to the power electronics unit 18. In other words, each group of heater can be electrically actuated independently. Hence, the array of heaters can perform sequential or synchronous firings. The rate and amount of atomization per sec can be adjusted. The ratio of the number of liquid outlet to heater does not need to be 1:1. It can be any appropriate ratio (e.g. 2:1, 1:3). Furthermore, the heater 18 does not need to be placed exactly under the liquid outlets 32. They can be offset to each other.

This heater array function allows users to have an ON-DEMAND atomization, and the user can adjust the amount of atomization needed. The firing droplet size and amount can also be adjusted by firing frequency and power, liquid outlet size and chamber size.

The power electronics unit 20 may include a battery and a circuitry. The power electronic unit 18 can provide battery power management and also electrical control for the array of heaters on the heater chip 16. The cable 22 can bridge the electrical connection between the power electronics unit 20 and the heater chip 16.

The nozzle plate 30 may be made of silicon, metal (e.g. stainless steel), metal alloy (e.g. NiCo) or even ceramic. There is no limitation on the material as long as tiny liquid outlets can be fabricated on the nozzle plate 30. The spacer 34 may be made of any non-conducting material such as polymer (e.g. Su-8 and polydimethylsiloxane (PDMS)).

The nozzle plate 30 may further be formed with at least one guiding member 50. The guiding member 50 can divide the firing chamber 40 into a plurality of sub-chambers 42 (see FIG. 3). The guiding member 50 can guide liquid movement in the sub-chambers 42. In the illustrated embodiment, the guiding member 50 may include four arc-shaped projections integrally formed on the surface of the heater chip 16 where the heater 18 is mounted. The four arc-shaped projections may be disposed proximate to four liquid inlets 24 respectively.

The bubble atomizer 10 disclosed in the present application is environmental friendly (i.e. lead free). It can be used for mist generation and/or aroma atomization. It is an atomization-on-demand device by which users can control the rate and amount of atomization. The atomizer 10 can be set at any orientation and will not affect its atomization function.

Figure 5:
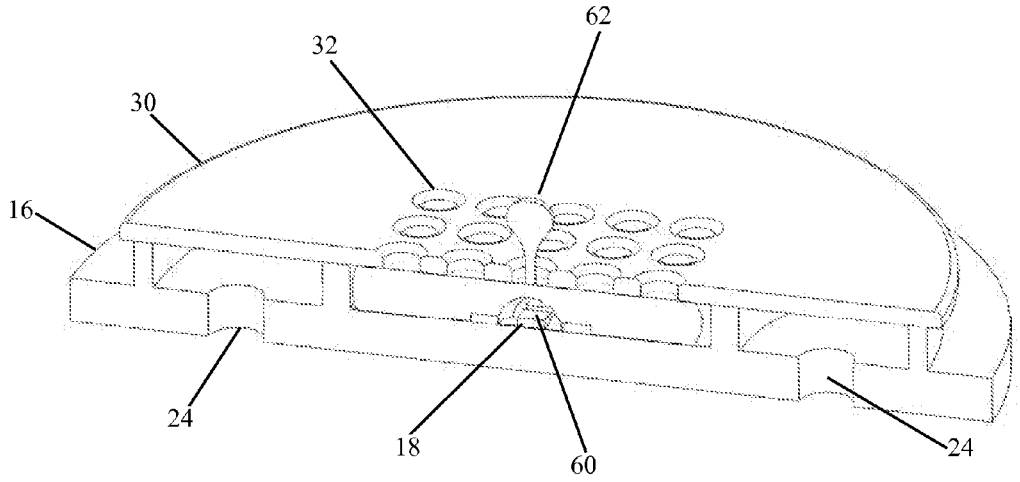
FIG. 5 shows the actuation principle of the bubble atomizer disclosed in the present application.

The atomizing principle is based on thermal bubble actuation effect. Actuation is based on superheating effect of at least one heater 18 which generates at least one thermal bubble 60 (see FIG. 5). The method for atomizing liquid is described in the following steps, as illustrated in FIGS. 7-12.

Figure 6:
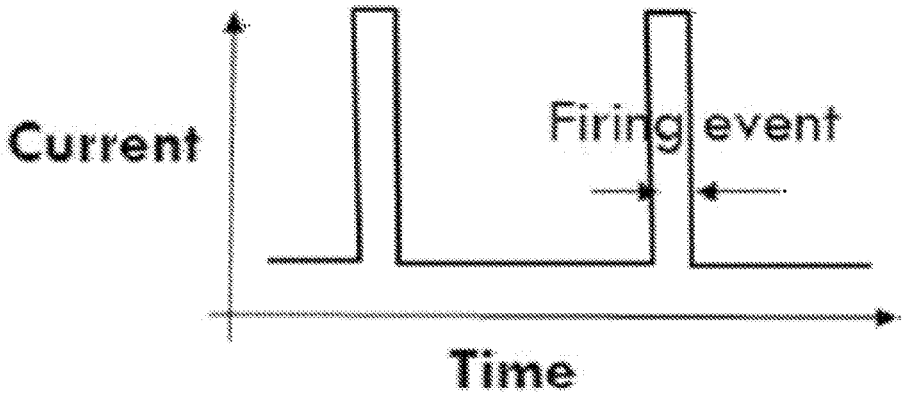
FIG. 6 is a graph showing a firing signal applied to the heaters.
Figure 7:
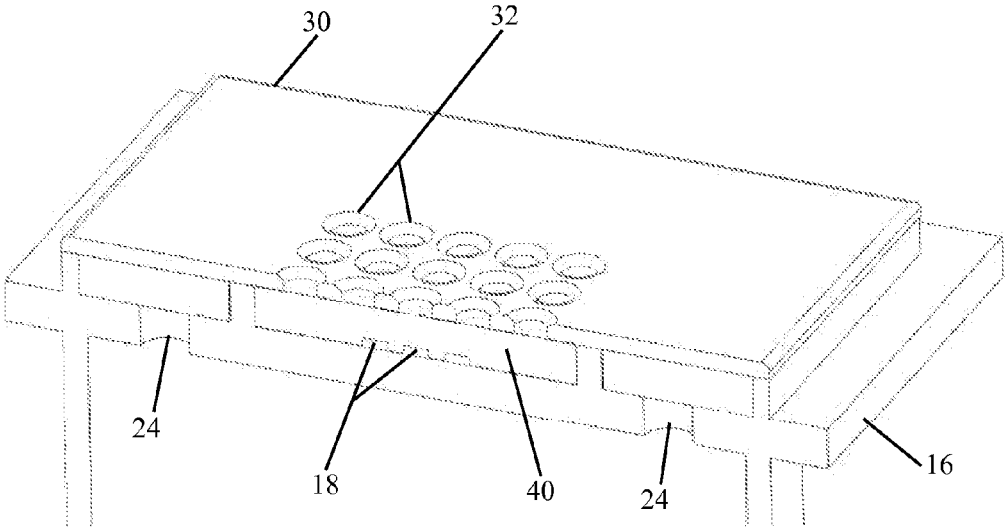
FIGS. 7-12 show the steps of a method for atomization according to an embodiment disclosed in the present application.
Figure 8:
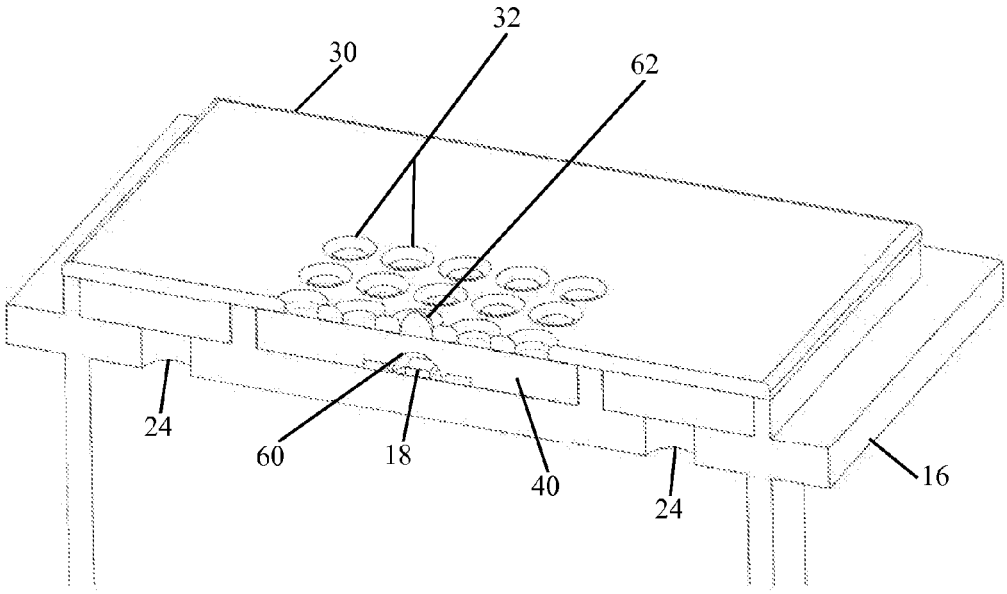
Figure 9:
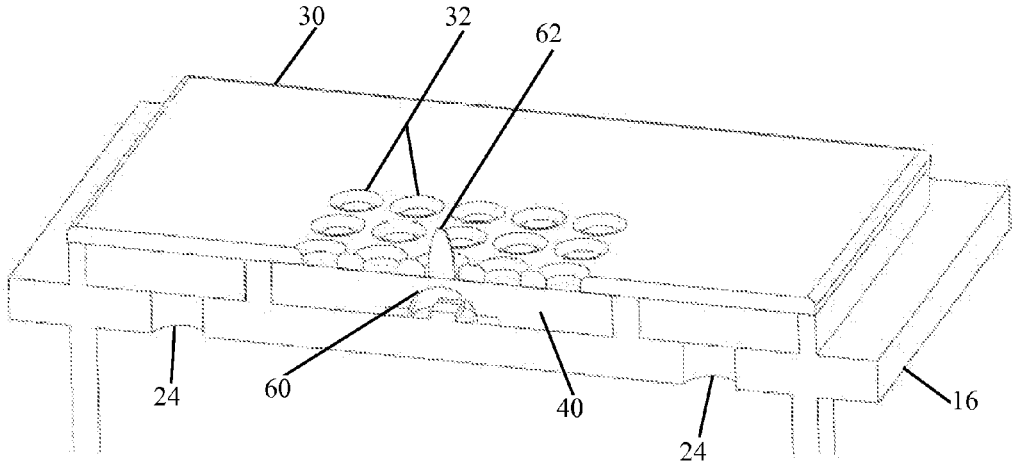
Figure 10:
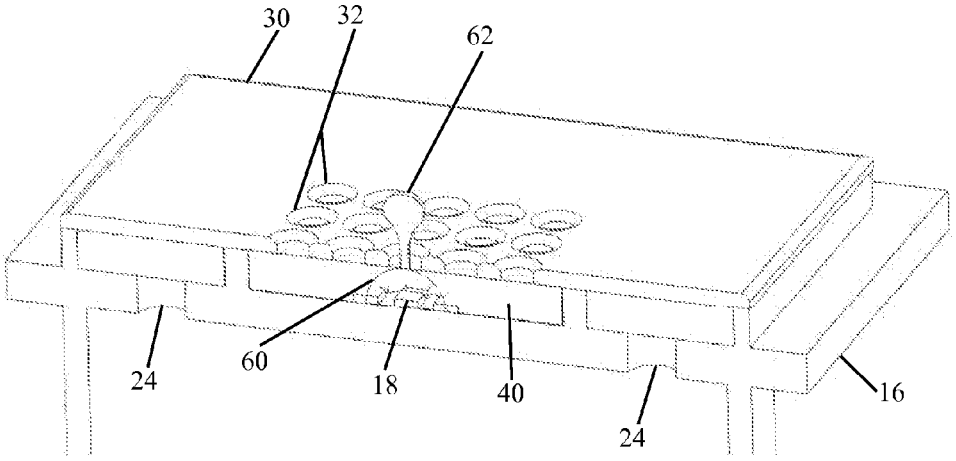
Figure 11:
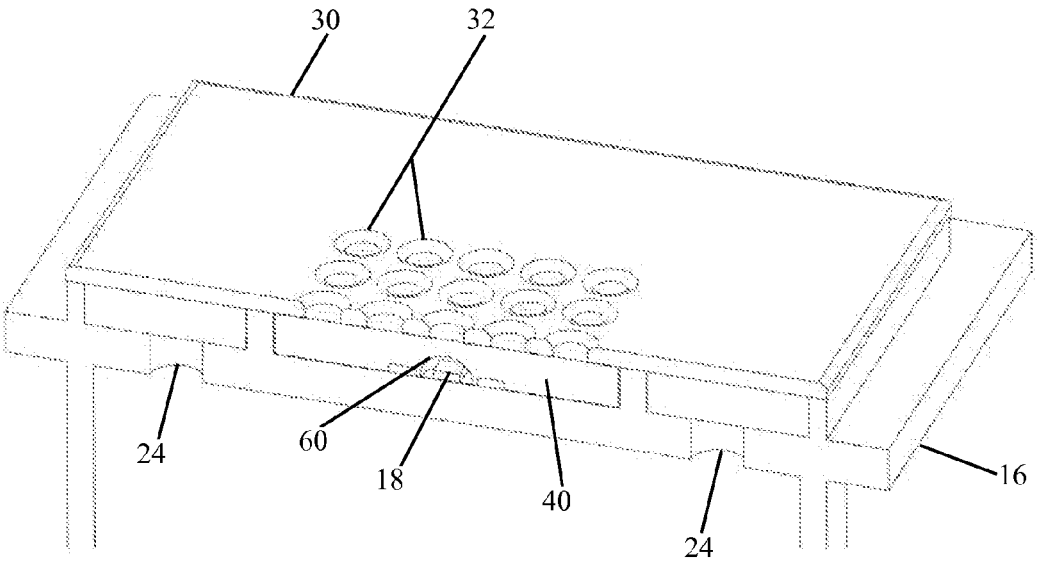
Figure 12:
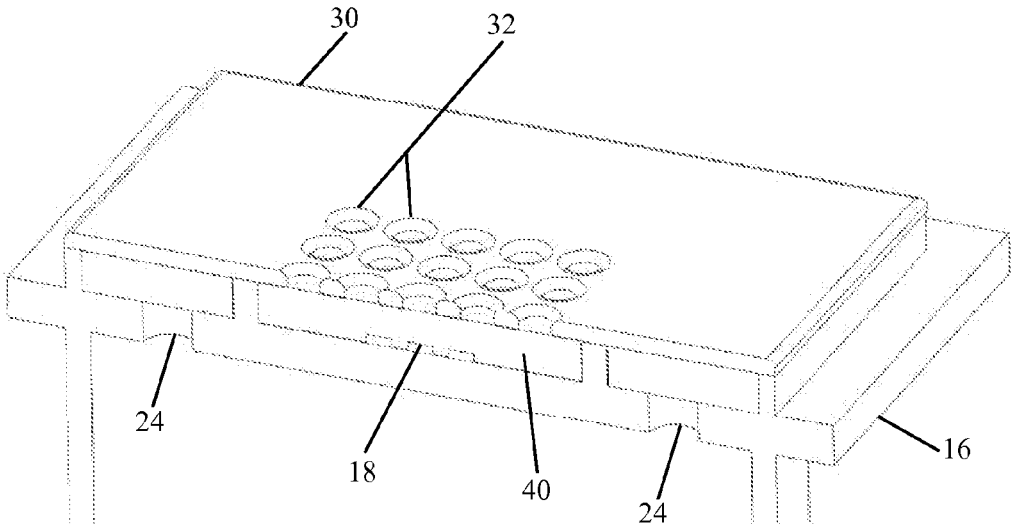

Step 1: At the beginning, the firing chamber 40 is filled with liquid from a water reservoir which may be defined by the cartridge 12 with the liquid absorbing member 14 provided therein. No power (i.e. OFF time of a pulse signal) is provided to the heaters 18 (FIG. 6).

Step 2: When a pulse signal is applied to the heater 18, the current generated by the power electronics unit 20 will heat up the heater 18 due to resistive heating. The heater 18 can be heated up to 200° C.-300° C. for a short period of time measured in terms of millisecond to microsecond (FIG. 6). In one embodiment, the period of time may be 10 ms. If the temperature exceeds the boiling point of the working liquid (i.e. 100° C. for water), superheating will occur and a vapor bubble 60 will be formed on a surface of the heater 18.

Step 3: The bubble 60 keeps expanding within the pulse period. The pressure inside the firing chamber 40 will be increased. The undisturbed liquid near the liquid outlet 32 will be pushed out of the firing chamber 40.

Step 4: A droplet 62 will be formed and ejected at the end of the pulse period and the bubble 60 will start to shrink and vanish. The liquid outlet 32 should have a lower "resistance" for liquid to go through than that of the liquid inlets 24. Otherwise, the liquid will be pushed back to the liquid reservoir (cartridge 12) rather than be ejected through the liquid outlet 32.

Step 5: While the bubble is collapsing, it creates a force for the liquid to be drawn from the liquid reservoir through the liquid inlet 24 and into the firing chamber 40. The heater 18 then cools down.

Step 6: The firing chamber 40 is restored to the initial stage of the firing process and waits for another firing event.

Figure 13:
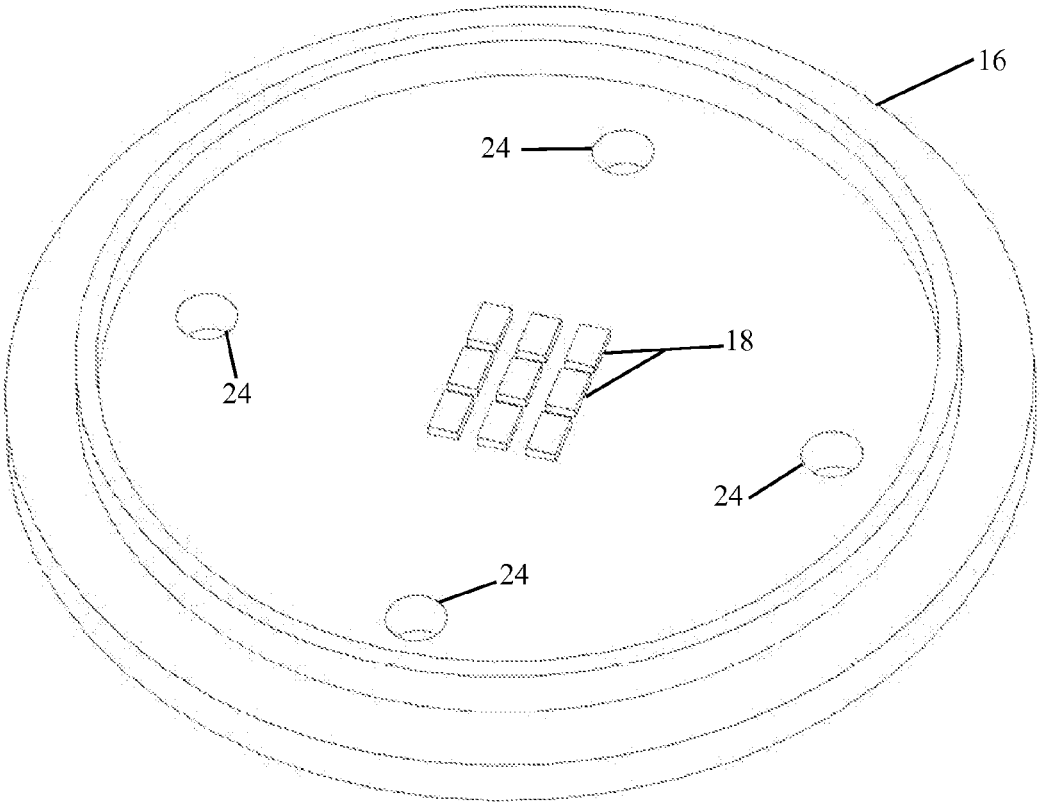
FIG. 13 shows a heater chip without guiding structures.
Figure 14:
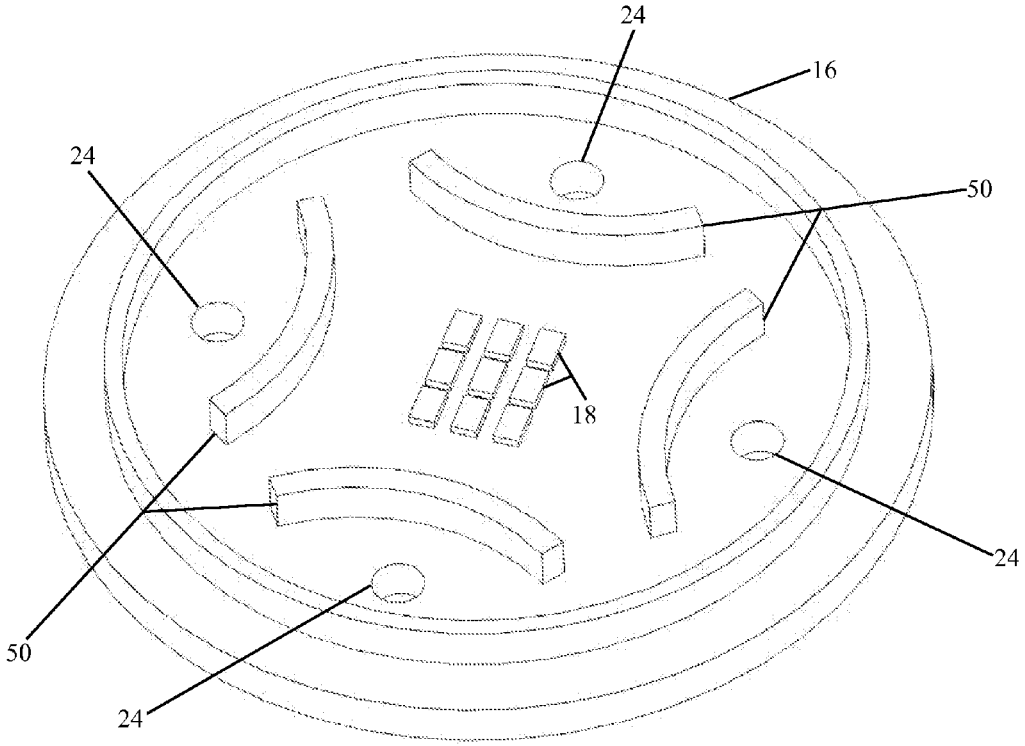
FIG. 14 shows a heater chip with guiding structures.
Figure 15A:
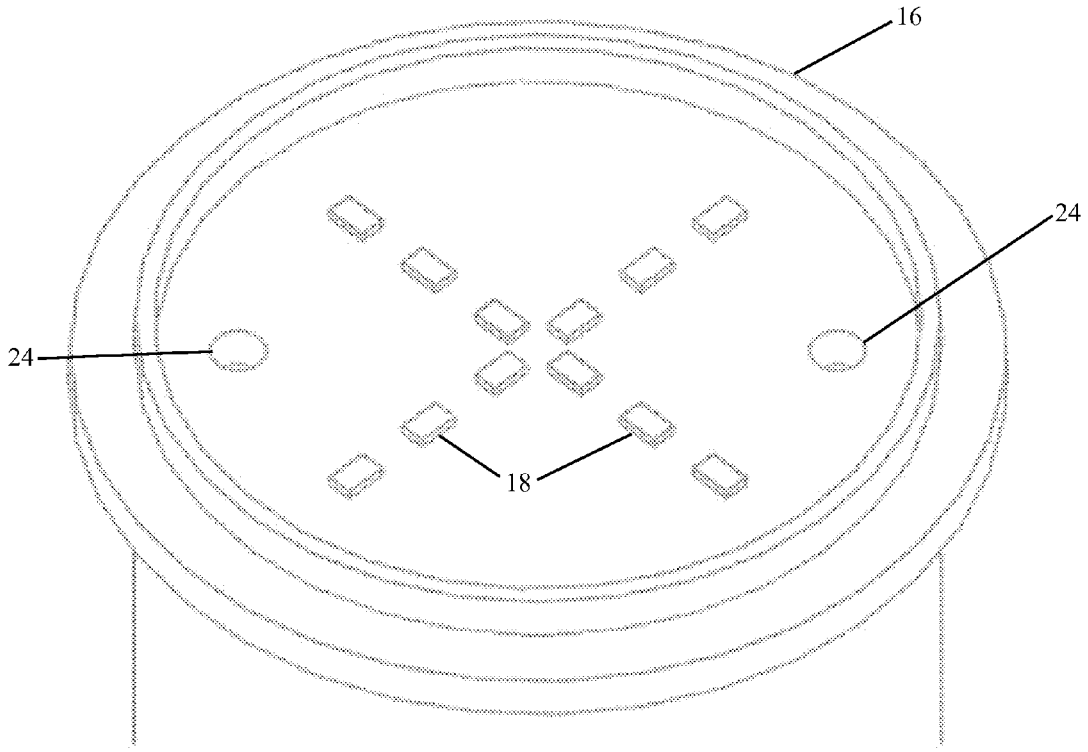
FIG. 15(*a*) shows a heater chip having a star-shaped array of heaters.
Figure 15B:
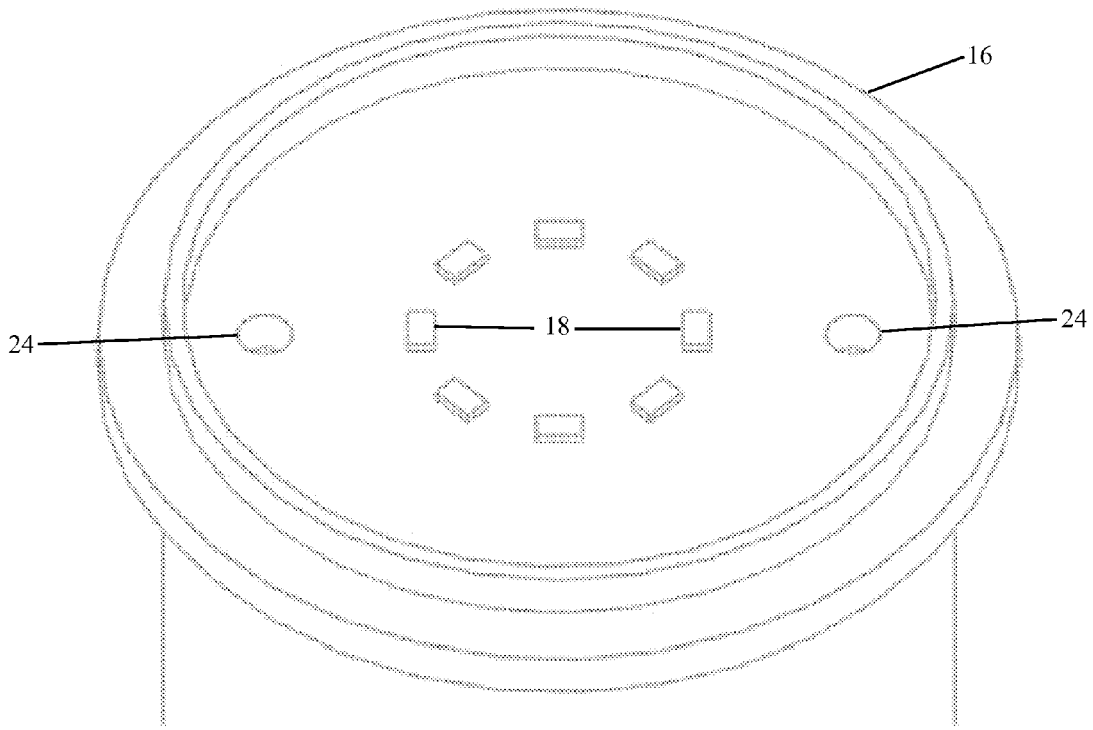
Figure 15C:
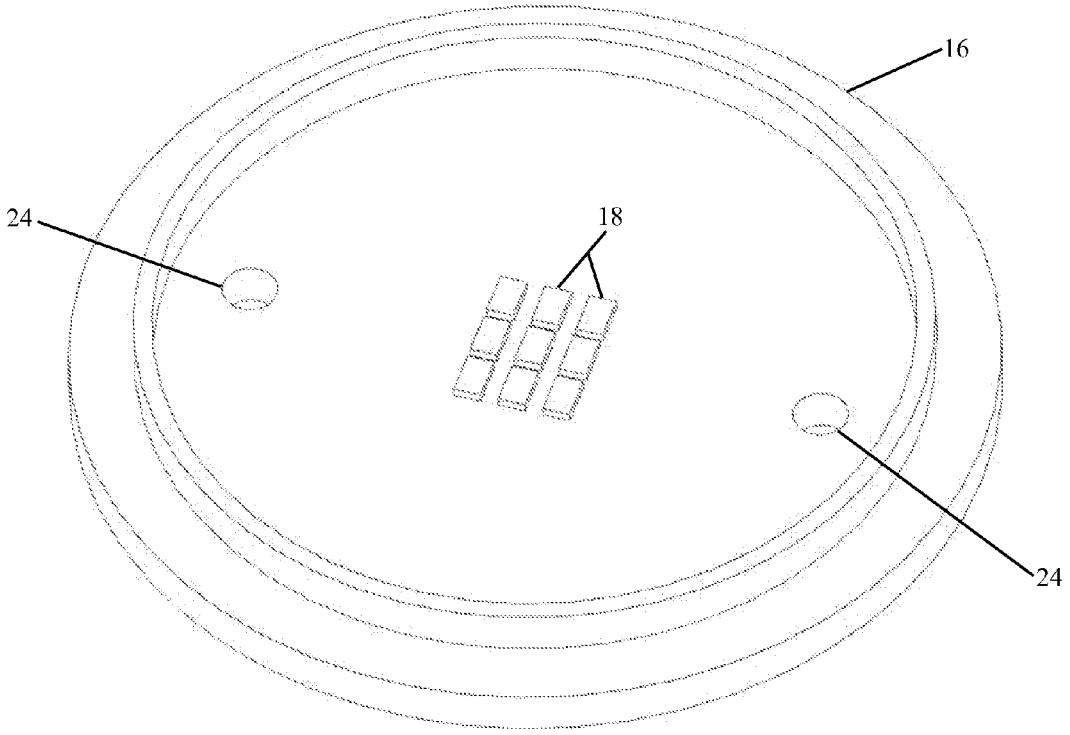
Figure 15D:
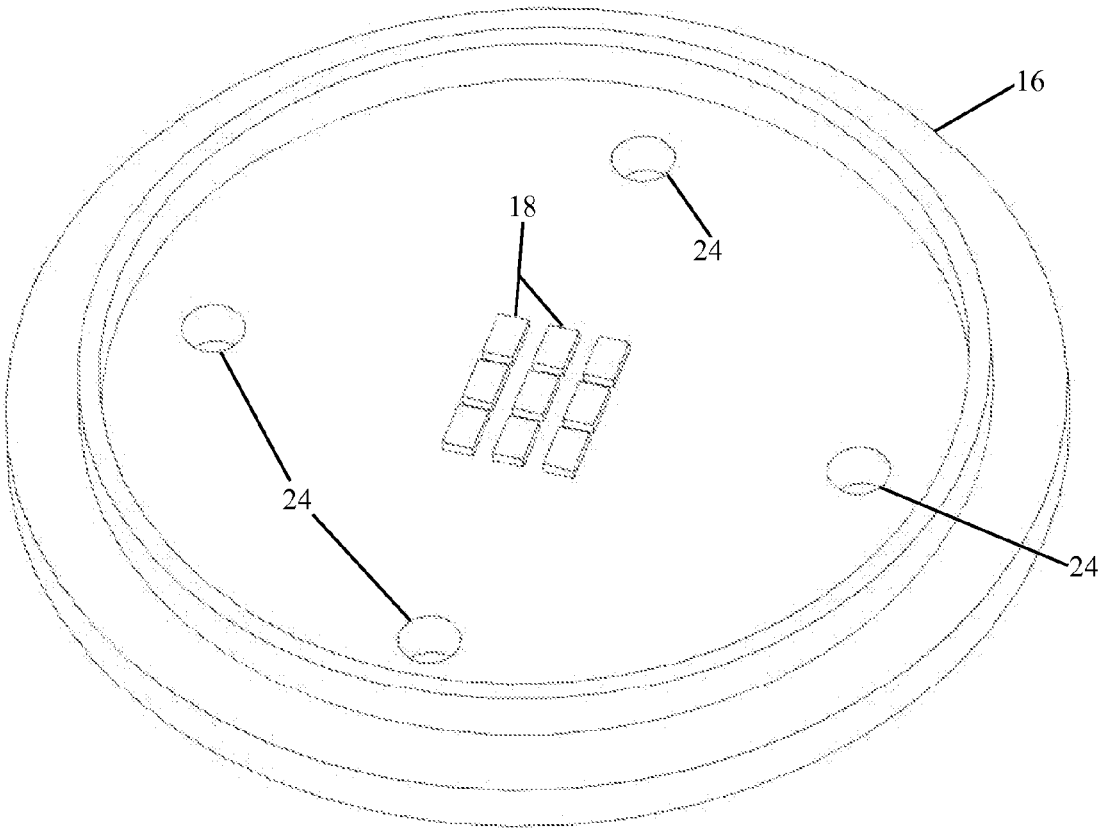

The heater chip 16 can be formed with or without the guiding member 50. FIG. 13 shows a heater chip 16 without any guiding member, and FIG. 14 shows a heater chip 16 integrally formed with the guiding member 50.

The array of heaters 18 can be arranged in many possible ways. FIG. 15(*a*) shows a heater chip 16 having a star-shaped array of heaters 18, and FIG. 15(*b*) shows a heater chip 16 having a circle-shaped array of heaters 18.

The heater chip 16 may be formed with any arbitrary number of liquid inlet 24. FIG. 15(*c*) shows a heater chip 16 having two liquid inlets 24, and FIG. 15(*d*) shows a heater chip 16 having four liquid inlets 24.

Figure 16:
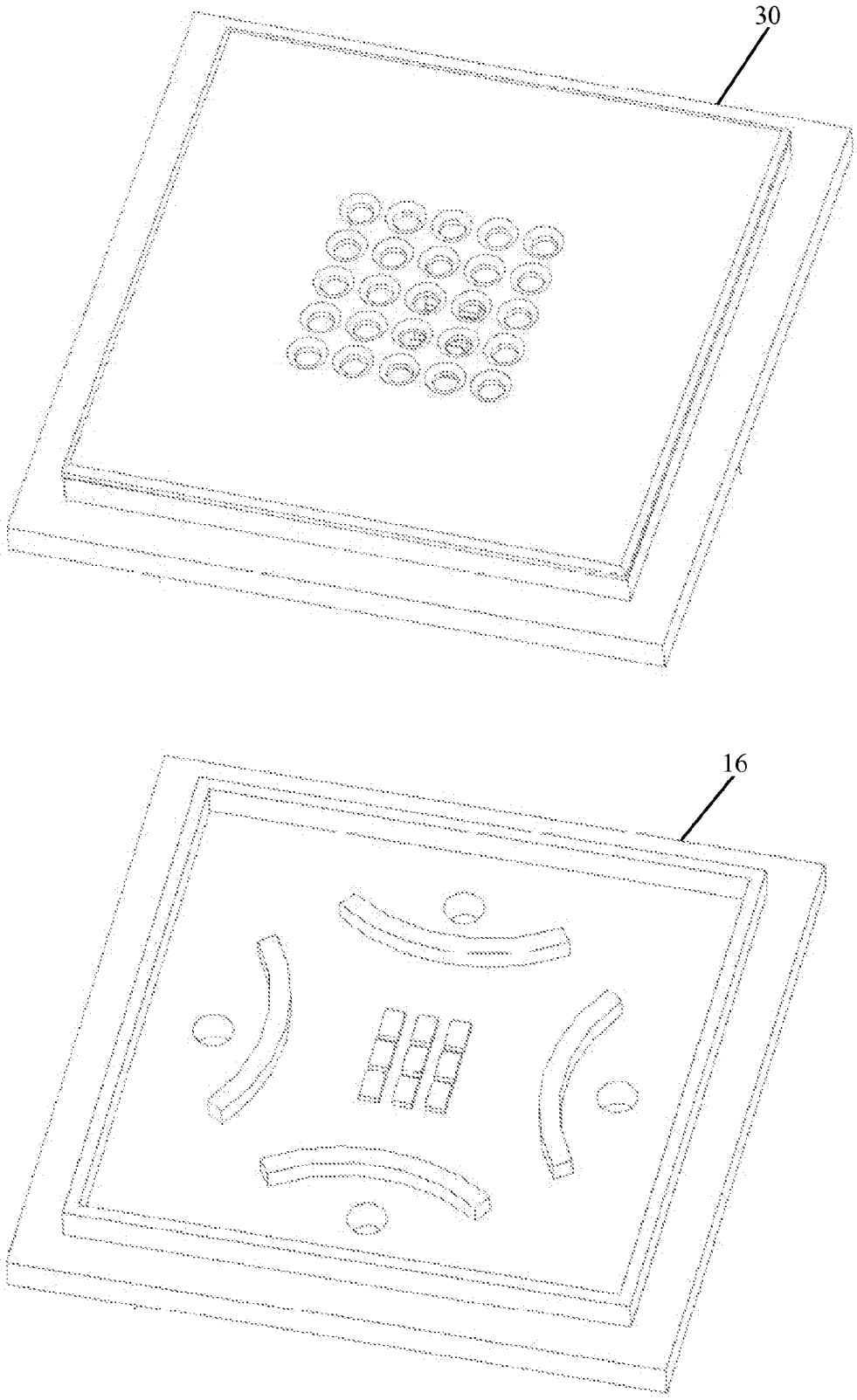
FIG. 16 is an exploded view of a square nozzle plate and a square heater chip.
Figure 17:
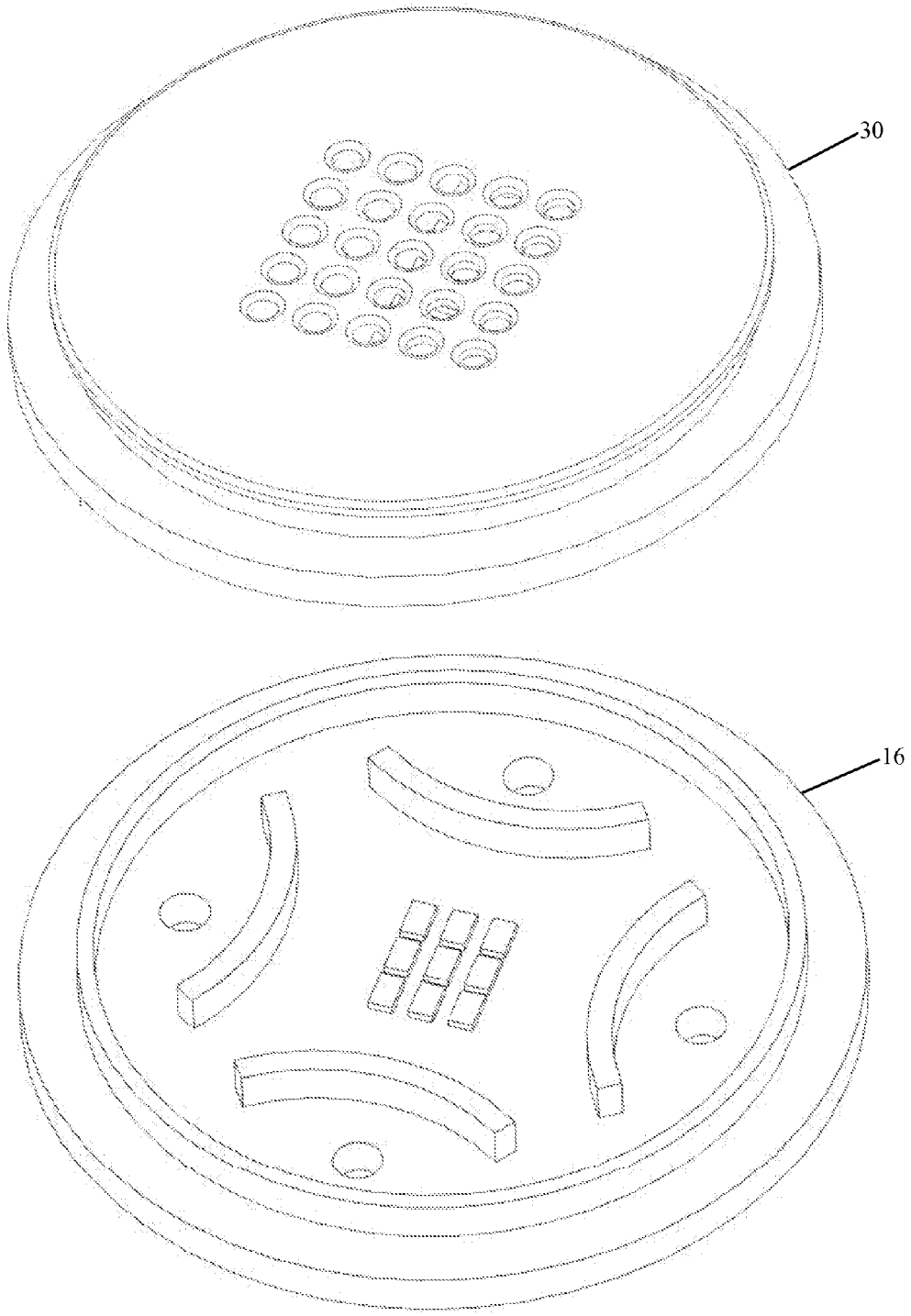
FIG. 17 is an exploded view of a circular nozzle plate and a circular heater chip.

The heater chip 16 and the nozzle plate 30 can be in any arbitrary shape depending on applications. FIG. 16 is an exploded view of a quadrilateral or square nozzle plate 30 and a quadrilateral or square heater chip 16. FIG. 17 is an exploded view of a circular nozzle plate 30 and a circular heater chip 16.

Figure 18:
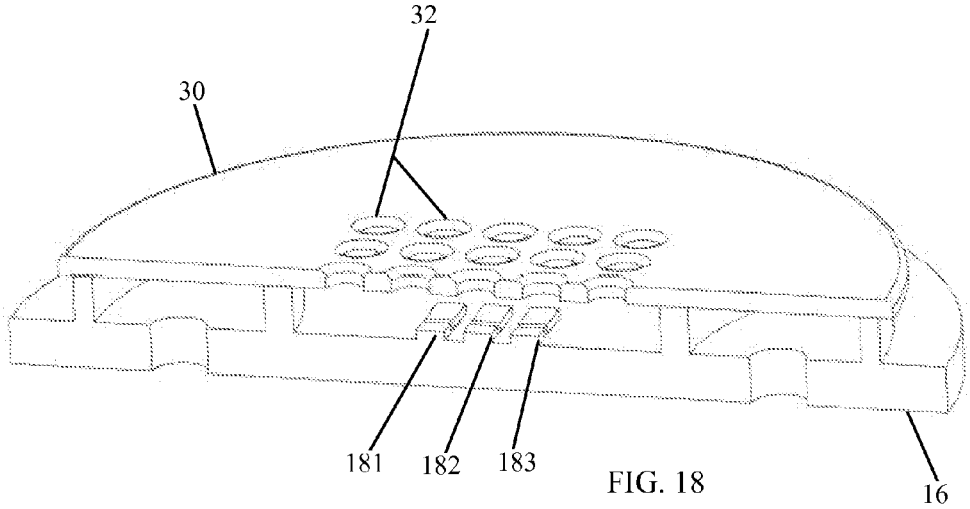
FIG. 18 is a cut-away view showing a heater chip with three heaters.
Figure 19:
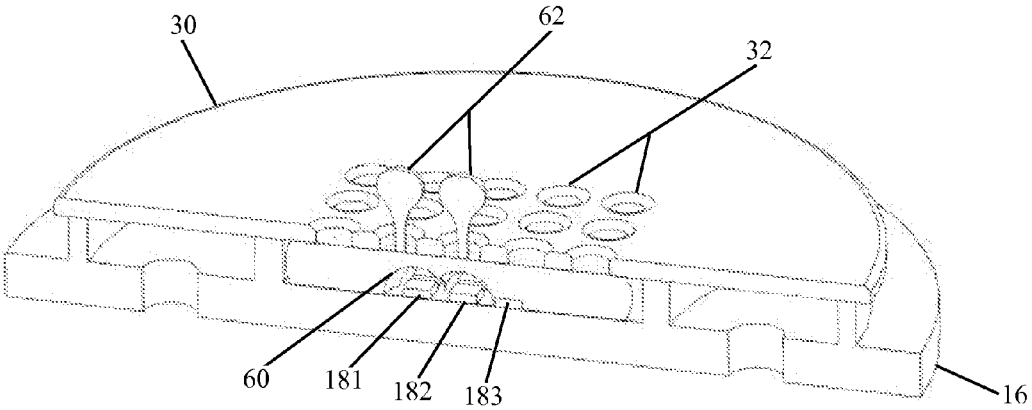
FIG. 19 is a cut-away view showing a heater chip with three heaters wherein only two heaters are activated.
Figure 20:
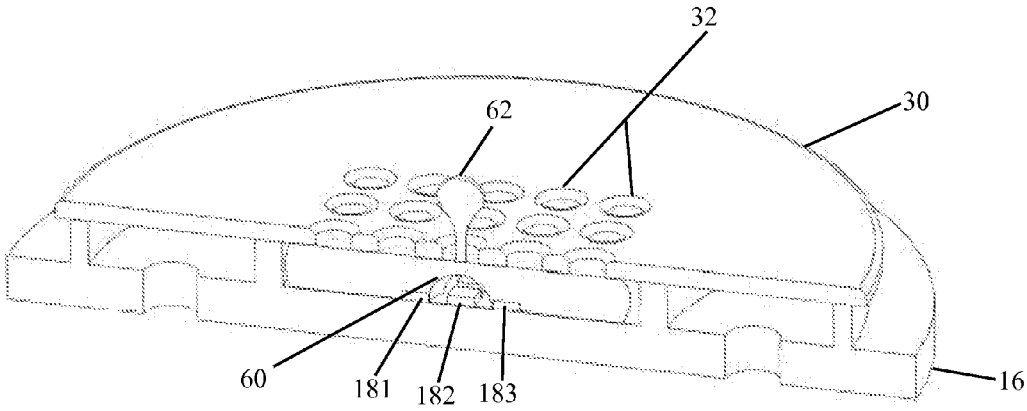
FIG. 20 is a cut-away view showing a heater chip with three heaters wherein only one heater is activated.
Figure 21:
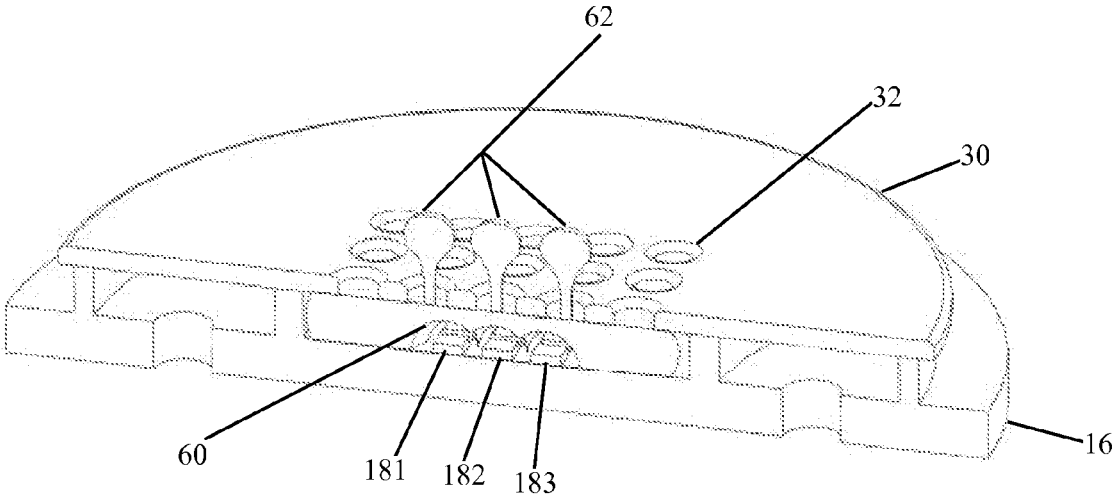
FIG. 21 is a cut-away view showing a heater chip with three heaters wherein all three heaters are activated.

FIG. 18 is a cut-away view showing the heater chip 16 with three heaters 181, 182, 183. FIG. 19 shows the heater chip 16 with three heaters 181, 182, 183 wherein only two heaters 181, 182 are activated. Thus, two droplets 62 are formed per firing event. FIG. 20 shows the heater chip 16 with three heaters 181, 182, 183 wherein only one heater 182 is activated. Thus, only one droplet 62 is formed per firing event. FIG. 21 shows the heater chip 16 with three heaters 181, 182, 183 wherein all three heaters 181, 182, 183 are activated. Thus, three droplets 62 are formed per firing event.

Figure 22:
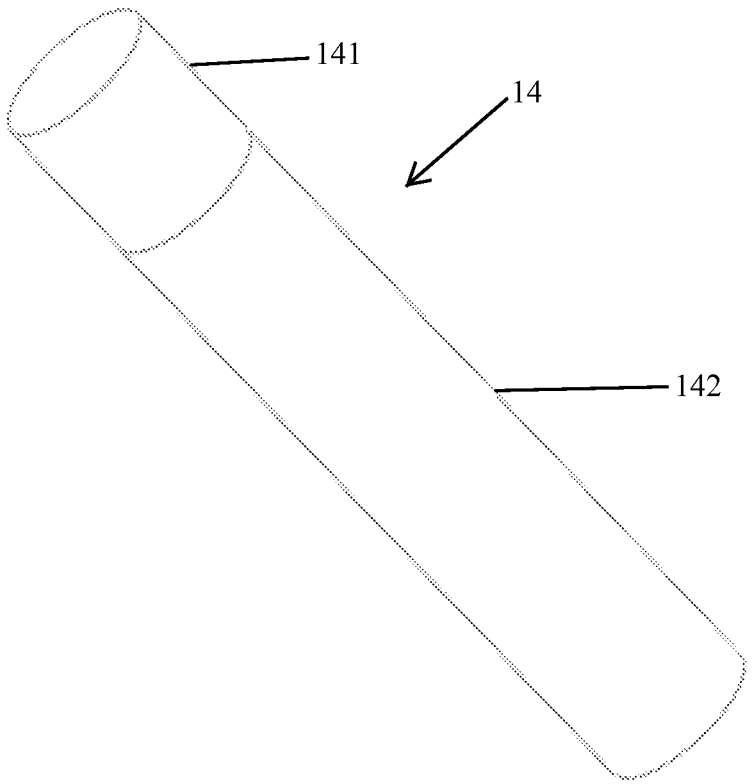
FIG. 22 is a perspective view of the liquid absorbing structure according to an embodiment disclosed in the present application.

FIG. 22 is a perspective view of the liquid absorbing member 14 according to an embodiment disclosed in the present application. In order to enhance the liquid absorbing and delivering capabilities of the atomizer, the liquid absorbing material can have a composition structure, instead of a homogenous one.

As depicted in FIG. 22, the liquid absorbing member 14 may include two parts, namely an upper or proximal part 141 and a lower or distal part 142. The upper part 141 may be in contact with the heater chip 16. This upper part 141 can absorb and hold excessive amount of liquid. The upper part 141 may serve as a reservoir for quickly refilling the firing chamber 40 with liquid. The material used can be, but not limited to, inkjet foam. The lower part 142 may be in contact with the upper part 141 and dispose at a distance from the heater chip 18. This lower part 142 can absorb and deliver liquid fast to the upper part 141 of the composition structure. Also, the lower part 142 may have a function of filtering unwanted particles in the liquid and prevent them from jamming the liquid outlet 32. The material used can be, but not limited to, high density foam and filtration foam. With this foam structure, the atomizer 10 can operate at any angle without affecting its atomization function.

The bubble atomizer disclosed in the present application can be a stand-alone device which may have the size of a pen. It can be used for beauty and health (e.g. moisturizing and comfort using aroma or liquid with medicine). It can be integrated into headphones for producing a sense of smell for video gaming and movie watching. It can eject liquid with smell (e.g. perfume or aroma liquid). It can also be integrated into smart phones or portable electronic devices for providing atomizing functions.

While the bubble atomizer has been shown and described with particular references to a number of preferred embodiments thereof, it should be noted that various other changes or modifications may be made without departing from the scope of the appended claims.

What is claimed is:

1. A bubble atomizer comprising:

(a) a cartridge having an open end;

(b) a liquid absorbing member provided inside the cartridge for holding therein a liquid;

(c) a heater chip covering the open end of the cartridge and formed with a plurality of liquid inlets through which the liquid from the cartridge passes;

(d) a plurality of heaters mounted on the heater chip and connected to a power electronics unit through a cable, each heater having a thickness in micron to sub-micron scale;

(e) a nozzle plate formed with a plurality of micron-sized liquid outlets and spaced apart from the heater chip by a spacer to define thereinbetween a firing chamber; and (f) a plurality of guiding members formed on a surface of the heater chip where the heaters are mounted, the guiding members being configured to divide the firing chamber into a plurality of sub-chambers and guide liquid movement in the sub-chambers;

(g) wherein when a pulse signal generated from the power electronics unit is applied to the heaters, current generated heats up the heaters and a plurality of vapor bubbles is formed on the heaters which generates pressure and pushes the liquid out of the firing chamber through the liquid outlets to thereby form a plurality of droplets.

2. A bubble atomizer for atomizing a liquid, the bubble atomizer comprising:

(a) a cartridge having an open end;

(b) a liquid absorbing member provided inside the cartridge for holding therein a liquid;

(c) a firing chamber covering the open end of the cartridge, the firing chamber being formed with at least one micron-sized liquid outlet and at least one liquid inlet through which the liquid enters the firing chamber from the cartridge; and (d) at least one heater mounted inside the firing chamber and connected with a power electronics unit through a cable, the heater having a thickness in micron to sub-micron scale;

(e) wherein when a pulse signal generated from the power electronics unit is applied to the heater, current generated heats up the heater and at least one vapor bubble is formed on the heater which generates pressure and pushes the liquid out of the firing chamber through the liquid outlet to thereby form at least one droplet, wherein the firing chamber comprises a heater chip on which the heater is mounted and the liquid inlet is formed; and wherein the bubble atomizer further comprises at least one guiding member formed on a surface of the heater chip where the heater is mounted, the guiding member being configured to divide the firing chamber into a plurality of sub-chambers and guide liquid movement in the sub-chambers.

3. The bubble atomizer as claimed in claim 2, wherein the firing chamber further comprises a nozzle plate on which the liquid outlet is formed, and the nozzle plate is spaced apart from the heater chip by a spacer.

4. The bubble atomizer as claimed in claim 2, wherein the liquid absorbing member comprises a proximal part that is in contact with the heater chip, and a distal part that is in contact with the proximal part and disposed at a distance from the heater chip.

5. The bubble atomizer as claimed in claim 4, wherein density of the distal part is higher than that of the proximal part, whereby the liquid in the distal part is absorbed, filtered and passed to the proximal part in which the liquid is absorbed and any excessive liquid is held.

6. The bubble atomizer as claimed in claim 2, wherein the firing chamber is provided with two or more groups of heater which are electrically operable independently.

7. The bubble atomizer as claimed in claim 2, wherein the liquid absorbing member is made of foam.

8. The bubble atomizer as claimed in claim 2, wherein the heater has a thickness of 300 nm.

9. The bubble atomizer as claimed in claim 2, wherein the micron-sized liquid outlet has a diameter of 25 um.

10. The bubble atomizer as claimed in claim 2, wherein the liquid comprises a substance selected from the group consisting of water, aroma, medicine and perfume.

11. The bubble atomizer as claimed in claim 2, wherein the heater is made of metal.

12. A method for atomizing a liquid with a bubble atomizer, the method comprising the steps of:

(a) providing at least one heater in a firing chamber, the heater having a thickness in micron to sub-micron scale;

(b) providing at least one guiding member formed on a surface of a heater chip where the heater is mounted to thereby divide the firing chamber into a plurality of sub-chambers and guide liquid movement in the sub-chambers;

(c) filling up the firing chamber with a liquid from a liquid reservoir through at least one liquid inlet formed on the firing chamber; and (d) applying a pulse signal to the heater by a power electronics unit to thereby generate current that heats the heater up to 200° C.-300° C. for a period of time measured in terms of millisecond to microsecond, thereby forming at least one vapor bubble on the heater which generates pressure and pushes the liquid out of the firing chamber through at least one liquid outlet formed on the firing chamber to thereby form at least one droplet.

13. The method as claimed in claim 12, further comprising the step of drawing liquid from the liquid reservoir to the firing chamber as the vapor bubble collapses to thereby refill the firing chamber.

14. The method as claimed in claim 12, wherein the liquid outlet has a lower resistance for the liquid to pass through than that of the liquid inlet.

15. The method as claimed in claim 12, wherein the liquid reservoir is provided therein with a liquid-absorbing member for absorbing and holding the liquid such that the atomizer can operate at any angle without affecting its atomization function.

16. The method as claimed in claim 12, comprising the steps of providing two or more groups of heater which are electrically operable independently, and sequentially activating the groups of heater.

17. The method as claimed in claim 12, comprising the steps of providing two or more groups of heater which are electrically operable independently, and simultaneously activating the groups of heater.

18. The method as claimed in claim 12, comprising the steps of providing two or more groups of heater which are electrically operable independently, and adjusting atomization rate by activating different groups of heater.

* * * * *